US011767203B2

(12) United States Patent
Serak

(10) Patent No.: US 11,767,203 B2
(45) Date of Patent: Sep. 26, 2023

(54) SYSTEM AND METHOD FOR ADJUSTABLE STANDING PLATFORM WITH FOOT PEDAL CONTROLS

(71) Applicant: LLC, LLC, Centennial, CO (US)

(72) Inventor: John Serak, Prospect, KY (US)

( * ) Notice: Subject to any disclaimer, the term of this patent is extended or adjusted under 35 U.S.C. 154(b) by 36 days.

(21) Appl. No.: 17/540,531

(22) Filed: Dec. 2, 2021

(65) Prior Publication Data

US 2022/0204323 A1 Jun. 30, 2022

Related U.S. Application Data

(60) Provisional application No. 63/132,288, filed on Dec. 30, 2020.

(51) Int. Cl.

| | |
|---|---|
| ***B66F 7/28*** | (2006.01) |
| ***B66F 7/06*** | (2006.01) |
| ***B66F 7/22*** | (2006.01) |
| ***G05G 1/46*** | (2008.04) |
| ***G05G 1/44*** | (2008.04) |

(52) U.S. Cl.

CPC ..... *B66F 7/28* (2013.01); *B66F 7/0633* (2013.01); *B66F 7/22* (2013.01); *G05G 1/44* (2013.01); *G05G 1/46* (2013.01)

(58) Field of Classification Search

CPC .... B66F 7/00; B66F 7/065; B66F 7/28; B66F 7/633; B66F 7/22; G05G 1/44; G05G 1/46; A61G 5/128

USPC ..... 254/120, 122, 124, 126

See application file for complete search history.

(56) References Cited

U.S. PATENT DOCUMENTS

| | | | | |
|---|---|---|---|---|
| 5,580,347 | A | 12/1996 | Reimels | |
| 6,364,330 | B1 | 4/2002 | Weber et al. | |
| 7,626,132 | B2 * | 12/2009 | Mezhinsky | A61F 9/00736 606/166 |
| 10,052,764 | B2 * | 8/2018 | Chelian | B25J 5/007 |
| 2015/0137567 | A1 * | 5/2015 | Smith | A61G 5/1059 297/183.1 |

* cited by examiner

*Primary Examiner* — Lee D Wilson
*Assistant Examiner* — Alberto Saenz
(74) *Attorney, Agent, or Firm* — Daniel W. Roberts; Law Offices of Daniel W. Roberts, LLC

(57) ABSTRACT

Provided is a system and method for an adjustable standing platform for a person. The adjustable standing platform includes a base structured and arranged to be disposed upon a support surface with a movable platform disposed above and generally parallel to the base, the movable platform having at least one removable foot pedal controller providing at least a portion of a standing area, each removable foot pedal controller in wireless communication with at least one associated remote base unit. An actuator couples the movable platform to the base, the actuator structured and arranged to move the movable platform generally towards or away from the base. A flexible outer element substantially enclosing the adjustable standing platform, the flexible outer element structured and arranged to expand and contract as the movable platform moves relative to the base. An associated method of providing and using the adjustable standing platform is also provided.

39 Claims, 9 Drawing Sheets

SYSTEM AND METHOD FOR ADJUSTABLE STANDING PLATFORM WITH FOOT PEDAL CONTROLS

CROSS REFERENCE TO RELATED APPLICATIONS

This application claims the benefit under 34 U.S.C. § 119(e) of U.S. Provisional Application No. 63/132,288 filed Dec. 30, 2020 and entitled SYSTEM AND METHOD FOR SURGEON OPERATING THEATER ADJUSTABLE STANDING PLATFORM WITH FOOT PEDAL CONTROLS, the disclosure of which is incorporated herein by reference.

FIELD OF THE INVENTION

The present invention relates generally to surgical operating theater equipment, and more specifically to an adaptable and adjustable standing platform for a surgeon.

BACKGROUND

Surgeons of all specialties face a common problem in the operating room. The surgeon must maintain an adequate view of and the ability to maneuver his or her hands within the operative field. Simply standing on the floor often does not provide for this due to a number of factors specific to the operation being performed. For example, the height of the patient upon the operating table relative to the height of the surgeon may make a directly downward view into the incision difficult if not impossible. The surgeon may also not be able to easily and quickly view other parts of the patient's body, or other members of the operating team. And of course, other issues and difficulties may present as well.

The solution has long been utilization of standing platforms in order to effectively increase the height of the surgeon in order to provide access to and visualization of the operative field.

One standing platform often does not provide enough height, requiring the surgeon to stand on two or more stacked platforms. This issue may be compounded when a surgeon and an assistant of differing heights both require access to and visualization of the same operative field. Further still, the height of the platform for one portion of a procedure may not be appropriate for another portion of procedure, requiring the surgeon, attendants, or other members of the operating team to adjust up or down the level of the platform—a task that cannot be performed while the surgeon is standing atop the platform.

In addition, surgeons as human beings are unique, which is to say that person's height is unique to them. Some people are tall and some are short. Standard platform heights may work for some surgeons, but not for others. The masterful skill of a particular surgeon should not be impeded by his or her discomfort during a procedure because of having to strain up or stoop down given standard platform dimensions.

A further problem ensues when foot pedals are placed on the platform. Surgeons often utilize foot pedals to activate a variety of surgical implements (cautery devices, drills, etc.). These pedals must be placed on the standing platform within range of the surgeon's foot. Traditional pedals consume a large portion of the platform surface area, which may force the surgeon into non-ergonomic body positions while operating.

Additionally, the pedals frequently fall from the platform, which requires an attendant to pick-up the pedal and reposition it on the platform. Another problem arises when the surgeon moves his or her foot onto the pedal or switches from one pedal to another. The surgeon is effectively forced to perform an operation balancing on a single leg, searching for the pedal with his or her foot while standing on an elevated platform.

The pedals are also prone to sliding around the surface of platform, which requires the surgeon to stop operating and look down to relocate the pedal. Moreover, the surgeon is essentially being required to perform an operation with delicate and precise care, while at the same time performing a balance routine to search out, find, balance and control one or more foot pedals.

Finally, foot pedals are typically wired to their respective base units. These connecting wires therefore run from wherever the pedals are placed—including upon a platform, across the floor to their respective base unit. The draping of wires from the pedals on a platform down to the floor often adds an element of imbalance to the pedal, and can contribute to it falling from the platform. Additionally, other members of the operating team may inadvertently catch on the wires and cause them to be pulled from the platform. Additionally, pedal positioning is limited by the length of its cord, requires positioning at the surgeon's foot by an attendant. While wireless foot pedals are available, such pedals they do not overcome the placement, falling and occupancy of standing real-estate noted above.

Addressing the problems outlined requires attention to the fixed height of current operating theater standing platforms, unsecured and non-ergonomic foot pedals and the issues resulting from wired pedals. A solution would provide the surgeon with the ability to adjust the standing platform height, incorporate fixed and ergonomically positioned foot pedals on the platform and would eliminate all wires.

Hence there is a need for a method and system that is capable of overcoming one or more of the above identified challenges.

SUMMARY OF THE INVENTION

Our invention solves the problems of the prior art by providing novel systems and methods for an operating theater standing platform with foot pedal controls.

In particular, and by way of example only, according to at least one embodiment, provided is an adjustable standing platform for a person, including: a base structured and arranged to be disposed upon a support surface; a movable platform disposed above and generally parallel to the base, the movable platform having at least one removable foot pedal controller providing at least a portion of a standing area, each removable foot pedal controller in wireless communication with at least one associated remote base unit; an actuator coupling the movable platform to the base, the actuator structured and arranged to move the movable platform generally towards or away from the base; and a flexible outer element substantially enclosing the adjustable standing platform, the flexible outer element structured and arranged to expand and contract as the movable platform moves relative to the base.

For yet another embodiment, provided is an adjustable standing platform for a person, including: a base structured and arranged to be disposed upon a support surface; a movable platform disposed above and generally parallel to the base, the movable platform having a standing area, disposed within the standing area is at least one removable foot pedal controller, each removable foot pedal controller in wireless communication with at least one associated remote base unit; an actuator coupling the movable platform to the base, the actuator structured and arranged to move the movable platform generally towards or away from the base; and a flexible outer element substantially enclosing the adjustable standing platform, the flexible outer element structured and arranged to expand and contract as the movable platform moves relative to the base.

Still, for yet another embodiment, provided is an adjustable stand for a person, including: a base structured and arranged to be disposed upon a support surface; a movable platform disposed above and generally parallel to the base, the movable platform having a plurality of foot activated elements, at least a subset of the plurality of foot activated elements in wireless communication with at least one remote base unit; an actuator coupling the movable platform to the base, the actuator structured and arranged to move the movable platform generally towards or away from the base in response to activation of at least one of the plurality of foot activated elements; and a flexible outer element substantially enclosing the adjustable standing platform, the flexible outer element structured and arranged to expand and contract as the movable platform moves relative to the base.

And still further, for yet another embodiment, provided is a method of providing an adjustable standing platform for a person, including: providing a base structured and arranged to be disposed upon a support surface; providing a movable platform disposed above and generally parallel to the base, the movable platform having at least one removable foot pedal controller providing at least a portion of a standing area, each removable foot pedal controller in wireless communication with at least one associated remote base unit; providing an actuator coupling the movable platform to the base, the actuator structured and arranged to move the movable platform generally towards or away from the base; and providing a flexible outer element substantially enclosing the adjustable standing platform, the flexible outer element structured and arranged to expand and contract as the movable platform moves relative to the base.

And further still, yet another embodiment provides a method of using an adjustable standing platform for a person, including: providing an adjustable standing platform for a person, the standing platform including: a base structured and arranged to be disposed upon a support surface; a movable platform disposed above and generally parallel to the base, the movable platform having a standing area, disposed within the standing area is at least one removable foot pedal controller, each removable foot pedal controller in wireless communication with at least one associated remote base unit; an actuator coupling the movable platform to the base, the actuator structured and arranged to move the movable platform generally towards or away from the base; and a flexible outer element substantially enclosing the adjustable standing platform, the flexible outer element structured and arranged to expand and contract as the movable platform moves relative to the base; stepping onto the adjustable standing platform; using a foot to activate to manipulate the at least one foot activated position controller disposed proximate to the standing area to adjust the height of the platform to a preferred level; and using the at least one removable foot pedal controller for the wireless control of at least one device.

BRIEF DESCRIPTION OF THE DRAWINGS

FIGS. 1A and 1D are perspective top views of an adjustable standing platform for a person in an extended state, in accordance with at least one embodiment;

DETAILED DESCRIPTION

Before proceeding with the detailed description, it is to be appreciated that the present teaching is by way of example only, not by limitation. The concepts herein are not limited to use or application with a specific system or method for adaptive elevation adjustment of a surgeon, and/or his or her improved ability for foot pedal control. Thus, although the instrumentalities described herein are for the convenience of explanation shown and described with respect to exemplary embodiments, it will be understood and appreciated that the principles herein may be applied equally in other types of systems and methods involving adjustable platforms.

This invention is described with respect to preferred embodiments in the following description with references to the Figures, in which like numbers represent the same or similar elements. It will be appreciated that the leading values identify the Figure in which the element is first identified and described, e.g., element 100 first appears in FIG. 1.

Figure 1A:
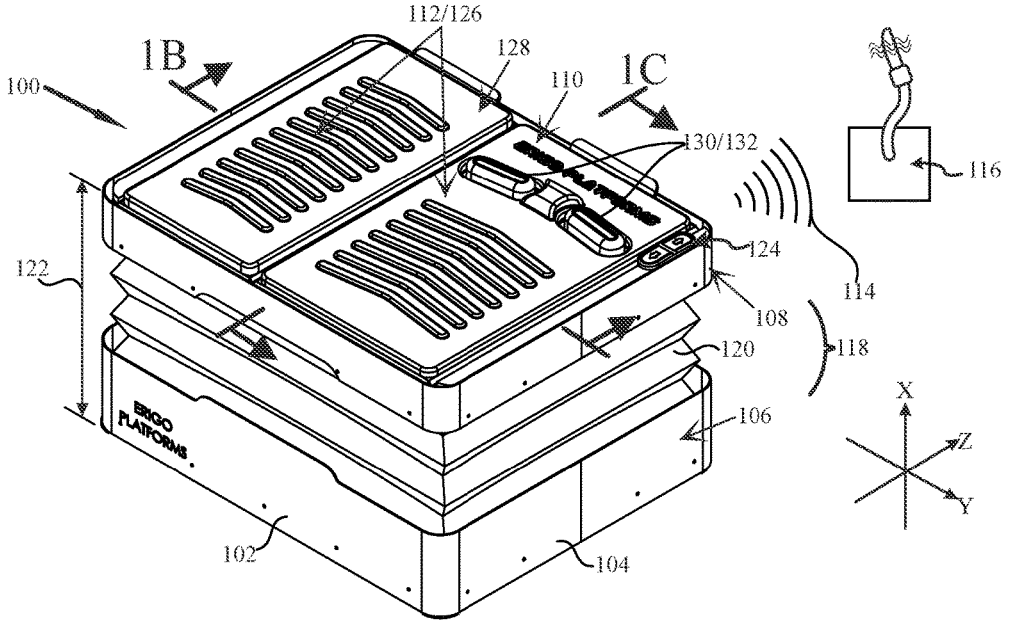

Turning now to the figures, and more specifically FIGS. 1A, 1B, 1C and 1D there is shown an adjustable standing platform with foot pedal controls 100, hereinafter ASP 100. FIG. 1A presents a perspective view of ASP 100, in an extended state, with FIG. 1B providing a front cut through view and FIG. 1C providing a side cut through view. For ease of discussion and illustration, ASP 100 is understood and appreciated to have a front 102 and a side 104, with FIG. 1B providing a front cut through view and FIG. 1C providing a side cut through view.

Figure 1B:
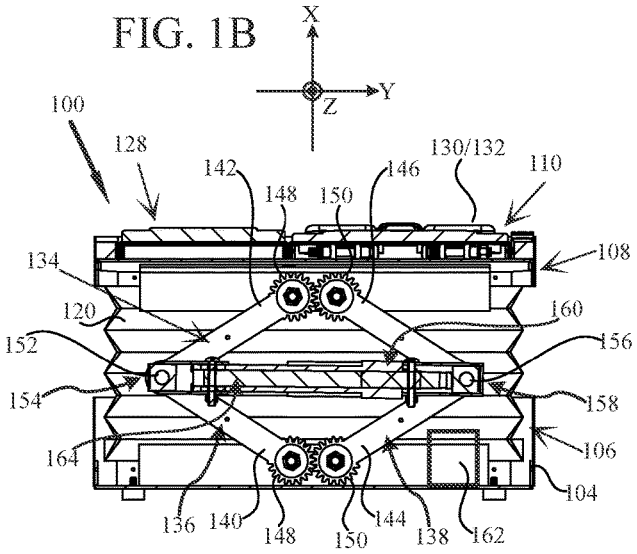
FIG. 1B is a front view of the adjustable standing platform shown in FIG. 1A, in accordance with at least one embodiment.
Figure 1C:
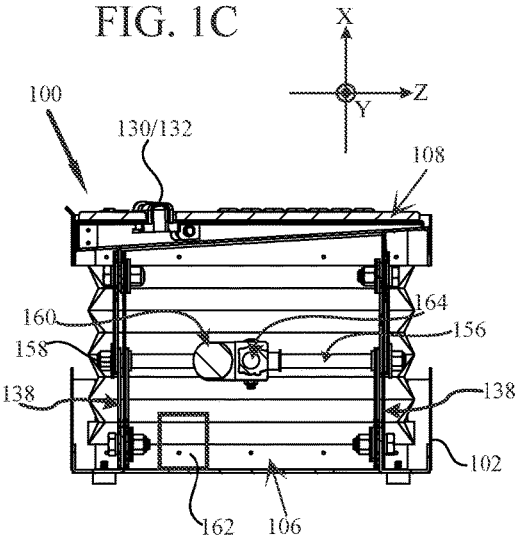
FIG. 1C is a side view of the adjustable standing platform shown in FIG. 1A, in accordance with at least one embodiment.
Figure 2A:
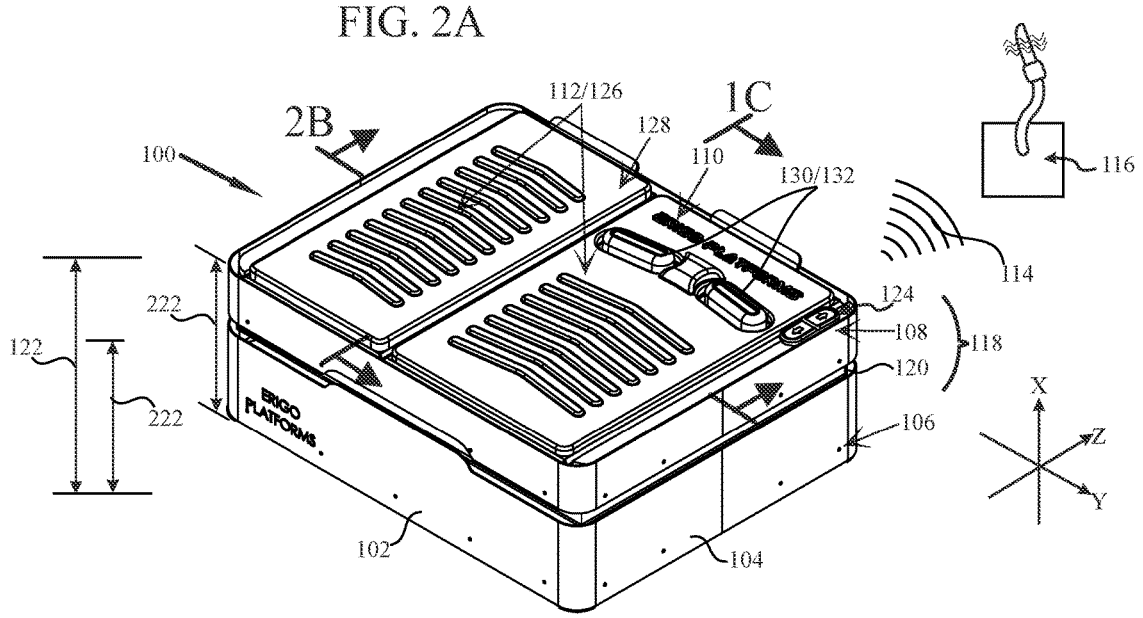
FIGS. 2A, 2B, and 2C present the same adjustable standing platform in a contracted state in substantially similar views as FIGS. 1A, 1B and 1C, in accordance with at least one embodiment.
Figure 2B:
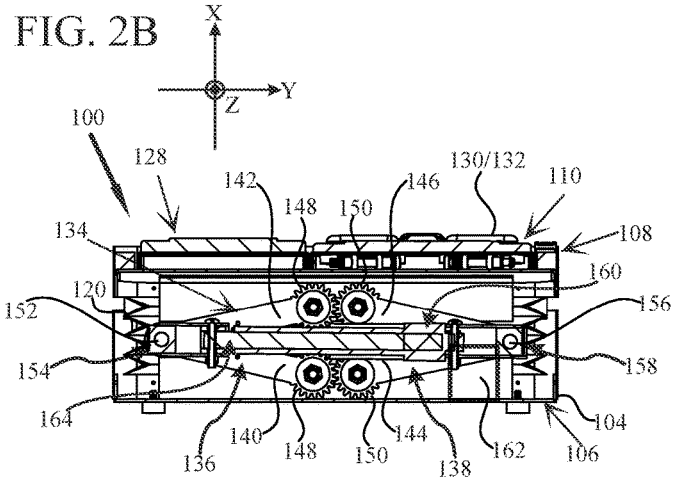
Figure 2C:
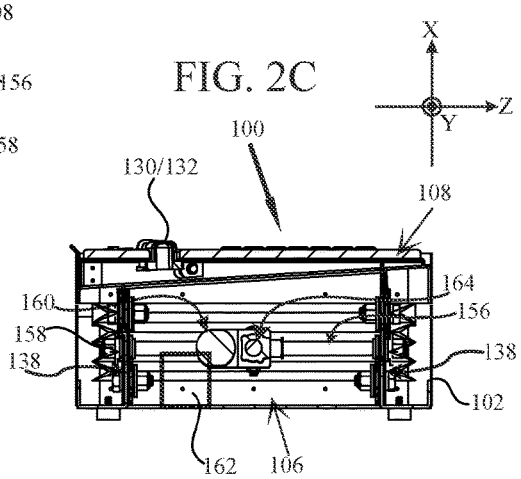

It will also be appreciated that FIGS. 2A, 2B and 2C substantially mirror the views of FIGS. 1A, 1B and 1C showing the ASP 100 in a non-extended state, such that the differences between the states may be more easily appreciated.

To facilitate the description of systems and methods for embodiments of ASP 100, the orientation of CFC 100 as presented in the figures is referenced to the coordinate system with three axes orthogonal to one another as shown in FIG. 1A. The axes intersect mutually at the origin of the coordinate system, which is chosen to be the center of ASP 100, however the axes shown in all figures are offset from their actual locations for clarity and ease of illustration.

As will be further illuminated in the following discussion, for at least one embodiment, ASP 100 may be summarized as an advantageous adjustable standing platform for a person, such as a doctor, that provides at least adjustable height to better permit the user to stand and work at an elevation that is most comfortable and conducive to optimal performance. More simply put, a surgeon as the user may easily adjust his or her standing position, as in at least his or her elevation, such that he or she is in the most optimum position to perform the task at hand—the operation or surgery task. In this optimized position the surgeon is also permitted to wirelessly control one or more remote devices through the activation of foot activated pedal controls. The person using the ASP 100 may also adjust the elevation level in real time without stepping off the ASP 100, as the adjustments may be directed by the person's feet as ASP 100 provides an integrated foot operated pedal system. The ASP 100 is self-powered and may be hermetically sealed such that it also minimizes tripping hazards through the elimination of wires across the floor, and may be easily cleaned and reused without harboring bacteria or contaminants.

As described herein, the foot operated controls are termed pedals, and though a pedal will be understood and appreciated to be a foot operated lever used to control a mechanism or device, it will be understood and appreciated that the term "pedal" as used herein, may refer to buttons, levers, sliders, force plate, pressure plates, or other such devices whether truly mechanical or not. More simply put, it will be understood and appreciated that pedal controls are those elements which are operated by a person's feet.

Indeed, the foot pedal system not only permits elevation adjustment of the ASP 100 itself, but also advantageously permits universal wireless control of one or more devices within the using person's area, i.e., an operating theater, such as but not limited to lights, drills, electrocauterization tools, fans, or such other devices as may be desired. As this control is achieved wirelessly, there is an advantageously reduced tripping hazard of cords and electrical lines across the floor.

For at least one embodiment, such an advantageous ASP 100 is provided by a base 106 structured and arranged to be disposed upon a support surface. A movable platform 108 is disposed above and generally parallel to the base 106, the movable platform 108 having at least one removable foot pedal controller 110 providing at least a portion of a standing area 112. Further, each removable foot pedal controller 110 is in wireless communication 114 with at least one associated remote base unit 116, conceptually shown to activate an electrocauterizer. Moreover, FIG. 1A presents an embodiment of ASP 100 having at least one foot pedal controller 110, and more specifically just one foot pedal controller. FIG. 1D presents an embodiment of ASP 100 having two foot pedal controllers 110 specifically foot pedal controller 110' which is conceptually shown in wireless communication 114' with remote base unit 116', and foot pedal controller 110" which is conceptually shown in wireless communication 114" with remote base unit 116".

Adjustment of the movable platform 108 is achieved by an actuator 118 coupling the movable platform 108 to the base 106, the actuator 118 structured and arranged to move—as in position and/or reposition—the movable platform 108 generally towards or away from the base 106. A flexible outer element 120 encloses the ASP 100 and is structured and arranged to expand and contract as the movable platform 108 moves relative to the base 106. This expansion and contraction may be further appreciated by comparing FIG. 1A to FIG. 2A, showing the change in state of the flexible outer element 120 as further evidenced by the change in elevation height 122 of the standing area 112 in FIG. 1A vs. the height 222 of the standing area 112 in FIG. 2A—height 222 being less than height 122.

For at least one embodiment, the actuator 118 is controlled by a separate set of foot pedal controllers, such as position controller 124 shown disposed adjacent to the standing area 112 on the outer perimeter of the movable platform 108. Although varying embodiments may incorporate or otherwise dispose the position controller 124 within the foot pedal controller 110, for at least one embodiment the separation of the position controller 124 from the foot pedal controller 110 may be desired so as to minimize the risk of accidental height adjustment while intending to control another device, and vis-a-versa. Although the position controller 124 has been shown and described proximate to the standing area 112, it will be understood and appreciated that for yet other embodiments, the position controller 124 may be disposed in a perpendicular side panel of ASP 100, such as sidewall of the base 102 along the front 102.

As shown, the position controller 124 may be toggle buttons or levers, such that both may not be depressed at the same time. For embodiments wherein the ASP 100 is advantageously capable of imparting horizontal movement as well as vertical movement to the movable platform 108, the position controller 124 may be provided as a pivoting disc, optional sets of buttons or levers, or such other operable elements as may be desired for ease of use and identification by tactile sensation through the operator's foot. For yet another embodiment, the position controller 124 may further include a voice activation/voice recognition element, such that the user may "request" adjustment up or down by physically moving his or her foot, or by vocal request.

This summary may be further appreciated with respect to the following description and review of the accompanying figures. As noted, for at least one embodiment, ASP 100 has a base 106 structured and arranged to be disposed upon a surface, such as the floor of an operating theater. Of course, it will be understood and appreciated that the base 106 may be disposed upon some intervening surface or element, such as a rug, plastic, or other material that may be disposed upon the floor for ease of cleaning and restoring the environment to a sterile condition following the surgical procedure.

As shown, for at least one embodiment the base 106 is essentially rectangular. The base may also have rubber feet or other traction providing materials to further establish a firm and non-sliding relationship with the surface upon which the base 106 is set. In varying embodiments, the base may have a plurality of distinct legs without departing from scope of the present invention.

ASP 100 further comprises a movable platform 108 that is disposed above, and generally parallel to, the base 106. The movable platform 108 provides a first surface 126 that may be appreciated as a standing area 112. As is shown, this standing area 112 has at least one foot pedal controller 110 disposed therein. For at least one embodiment, the at least one foot pedal controller 110 is a removable foot pedal controller.

In addition, for at least one embodiment the standing area 112 also has at least one spacer 128 disposed adjacent to the at least one foot pedal controller 110. As may be appreciated from FIG. 1A, for at least one embodiment the at least one foot pedal controller 110 and the spacer 128 comprise at least a portion of the standing area 112.

As is shown in FIG. 1A, the at least one foot pedal controller 110 is shown to be substantially in the right portion of the standing area 112. It will be appreciated that the location of the at least one foot pedal controller 110 and the spacer 128 may be reversed such that the at least one foot pedal controller 110 may be disposed in the left portion of the standing area 112.

For yet another embodiment, two or more removable spacer 128 may be employed and disposed on either side of the at least one foot pedal controller 110 such that the foot pedal controller 110 is substantially centered in the standing area 112. For still yet another embodiment, the spacer 128 may be removed and replaced with a second foot pedal controller (not shown), such that there are two foot pedal controllers 110 side by side and comprising at least a portion of the standing area 112. Moreover, the location of the at least one foot pedal controller 110 may be easily and quickly adjusted—even during the course of an operation, so as to permit the user to choose, and or change, which foot he or she uses to activate the removable foot pedal controller 110.

Although the embodiment shown in FIG. 1A depicts the removable foot pedal controller 110 being of a sufficient size to extend across substantially all of a portion of the standing area 112, it will be appreciated that in varying embodiments, one or more removable foot pedal controllers 110 may be smaller elements that are disposed in an area proximate to the location of a user's toes when he or she is standing upon the ASP 100.

Moreover, it will be appreciated that these foot pedal controllers 110 are removable and reconfigurable. Moreover, the foot pedal controllers can be swapped—as in left to right, removed for placement upon the floor with yet another foot pedal controller 110 disposed in the standing area 112 of the ASP 100, or a blank disposed therein to re-establish the standing area 112.

As is conceptually shown, each foot pedal controller 110 provides at least one foot activated element 130, such as a button or press switch 132. For at least one embodiment, at least one of the foot activated elements 130 is provided as a tactile area/object/element such that the user can tell by feel when he or she has his or her foot disposed thereupon.

It will be understood and appreciated that in varying embodiments, the one or more foot activated elements 130 may be integrated as components of the foot pedal controller 110, or they too may be removable and interchangeable. As is shown, the foot pedal controller 110 may provide a plurality of foot activated elements 130, such that any given foot pedal controller 110 may permit the user standing upon the ASP 100 to independently and discretely control a plurality of various devices.

Moreover, for an embodiment of ASP 100 suitable for an operating theater environment, each of the at least one foot pedal controller 110 is structured and arranged to control a surgical device such as an electrocautery device, drill, saw, or other surgical device. More simply stated, it will be understood and appreciated that one or more foot pedal controllers may be configured for control of essentially any device within the operating theater that is operable as an on/off, variable speed or variable intensity device.

More specifically, the foot pedal controller 110 may wirelessly communicate with, and thereby control, a remote base unit 116 that is the controlling base unit of a specific device, or the base unit 116 may be a universally adaptable device which essentially provides on/off and variable power control which in turn is supplied to the device adaptively controlled by the foot pedal controller 110. In more simple terms, for at least one embodiment the foot pedal controller 110 may be configured to directly control a device (saw, light, cauterizing tool, etc. . . . ) that is provided with embedded technology permitting remote control, or in an alternative embodiment, the foot pedal controller 110 may be configured to control a remote powered switch into which the desired device is plugged.

As such, it will be understood and appreciated that the foot pedal controller 110, and more specifically the foot activated elements 130 can advantageously wirelessly control one or more devices that are not otherwise capable of wireless control in their original state.

For at least one embodiment, the foot activated element 130 is pressed once for "on" and pressed again for "off". For yet another embodiment the foot activated element 130 is pressed for "on" (and held) and released for "off". And for still yet another embodiment the foot activated element 130 is responsive to pressure—the harder it is pressed the higher the level of activation for the controlled device—e.g., the harder the activator is pressed the faster a drill bit or saw blade spins, the greater the suction, the more intense the jet of air or hydration, etc. . . . .

Further, for at least one embodiment, the state of at least one of the foot activated elements 130 may also be perceived by the user—partially or fully depressed, partially or fully extended, slider location, or the like. For at least one embodiment, the state may also be communicated by vibration—e.g., off is no vibration and on has vibration. The degree of vibration may optionally indicate the degree of power being supplied to the controlled device.

As has been conceptually illustrated, each of the removable foot pedal controllers is appreciated to be in wireless communication 114 with at least one associated remote base unit 116. It will be understood and appreciated that this wireless communication 114 may be a variety of different means for different embodiments, such as but not limited to WiFi, BluTooth, ad-hoc network, optical, infra-red (IR), ultraviolet (UV), sonar, or other applicable wireless technology. Indeed, it is to be specifically understood and appreciated that non radio frequency (RF) wireless communication options may be employed so as to advantageously permit use and operation of ASP 100 within an operating theater wherein the absence of RF interference, or at least significant limitation of RF interference is desired.

It will also be appreciated that even within the same embodiment, different foot activated elements 130 of a given foot pedal controller 110 may initiate different types of wireless communication. For at least one embodiment, the wireless transceiver of the desired wireless communication protocol is at least partially disposed within the foot pedal controller 110, the foot activated element 130 as a button, slide, pressure sensor, or other interactive element may be incorporated with operational circuitry provided by the foot pedal controller 110 to trigger activation of the wireless transceiver. For yet another embodiment, at least one foot activated element 130 also incorporates the wireless transceiver component.

For at least one embodiment, electrical power for the operation of the at least one foot pedal controller 110, is provided by the power supply unit within the ASP 100 itself, as described further below. For another embodiment, the foot pedal controller 110 has its own power internal power supply (not shown in FIG. 1A-C or 2A-C) such that the foot pedal controller 110 may be operated even when removed from the ASP 100. Such an embodiment may also provide electrical contacts so as to permit the internal power supply of the foot pedal controller 110 to be charged when the foot pedal controller 110 is disposed in the standing area 112 of the movable platform 108.

For yet another embodiment, electrical power for activation of the wireless transceiver of the foot pedal controller 110 or the foot activated element 130 itself is provided by an electro-mechanical energy converter, essentially harvesting the kinetic energy of the button press to generate sufficient energy for a low power transmission.

As may be appreciated from FIG. 1B and FIG. 1C illustrating partial cut through views of ASP 100, adjustment of the movable platform 108 is achieved by an actuator 118 coupling the movable platform 108 to the base 106. The actuator 118 is structured and arranged to move the movable platform 108 generally towards or away from the base 106. For at least one embodiment, the actuator 118 may optionally be also structured to move the movable platform 108 laterally with respect to the base 106, and/or to tilt the movable platform 108 with respect to the base 106.

As shown, for at least one embodiment the actuator 118 is a scissor jack 134. A scissor jack 134 may be provided in a variety of configurations, and the use of one does not preclude the use of another. For at least one embodiment, a scissor jack 134 is provided as shown.

With reference to both FIG. 1B (side view) and FIG. 1C (end view), it may be appreciated that the scissor jack 134 essentially comprises two first supports 136 opposing two second supports 138. First supports 136 have first ends 140 rotatably coupled to the base 106 and second ends 142 rotatably coupled to the moving platform 108. Similarly, the second supports 138 have third ends 144 rotatably coupled to the base 106 and fourth ends 146 rotatably coupled to the moving platform 108. As shown, for at least one embodiment, the first ends 140 and second ends 142 have gears 148 engaging mating gears 150 on the third ends 144 and fourth ends 146, thereby further ensuring mirrored movement between the first supports 136 and the second supports 138 and thus further assuring uniform and parallel motion of the movable platform 108.

As identified in FIG. 1B, a first cross pin 152 is disposed between the midpoints 154 of first support 136 and second cross pin 156 is disposed between the midpoints 158 of second support 138. Second cross pin 156 may be further appreciated in FIG. 1C.

For the embodiment as shown, an electric motor 160 is disposed upon, or incorporated as an element of second cross pin 156 and powered by an internal power supply 162, such as a battery. A threaded shaft 164 is rotatable coupled to second cross pin 156 and engaged to a corresponding drive head of electric motor 160.

For at least one embodiment, the threaded shaft 164 passes through the corresponding drive head of the electric motor 160, and may therefore pass through at least a portion of the motor 160. For yet another embodiment, the motor is disposed to the side of the threaded shaft 164, the drive head of the motor driving the threaded shaft 164 past the outside of the motor 160.

As the threaded shaft 164 is rotated clockwise or counter clockwise, it will be understood and appreciated that the mating threads of the second cross pin 156, or threaded shaft receiver coupled to the second cross pin 156 will interact between the threads will drive the threaded shaft 164 towards or away from the second cross pin 156. Accordingly, as electric motor 160 is powered in a first direction, the rotation of the drive head will pull the threaded shaft 164 through electric motor 160 and thereby draw the first supports 136 and second supports 138 towards each other driving the moving platform 108 away (upward) from the base 106.

When the electric motor 160 is powered in a second direction, the rotation of the drive head will push the threaded shaft 164 away from the electric motor 160 and thereby increase separation between the first supports 136 and the second supports 138 with the result of pulling the moving platform 108 towards (downward) the base 106.

It will be understood and appreciated that alternative configurations for the arrangement of the motor 160 to drive the threaded shaft through corresponding mating threads disposed in the second cross pin 156, the first cross pin 152 and the drive head of the motor 160 may be implemented for alternative configurations of powering the actuator 118, and more specifically the scissor jack 134 without departing from the scope of the teachings herein.

Moreover, for the embodiment shown, it will be appreciated that the ends of the first supports 136 and second supports 138 remain in substantially the same location, though rotating about pivot attachments rotatably coupling their respective ends to the base 106 and the movable platform 108 respectively—it being the midpoints 154 of the first supports 136 and the midpoints 156 of the second supports 138 that move laterally as the scissor jack 134 expands or contracts.

An alternative scissor jack (not shown), may be appreciated to be one where the first and second supports actually cross each other, such that their respective midpoints are aligned and rotatably pinned, while the respective ends are slidably attached to the base 106 and the movable platform 108. For such an embodiment, the threaded shaft 164 is repositioned to engage between the ends either adjacent to the base 106 or the movable platform 108.

A flexible outer element 120 encloses the ASP 100 and is structured and arranged to expand and contract as the movable platform 108 moves relative to the base 106—again compare the illustrations of at least FIG. 1A and FIG. 2A. For at least one embodiment, the flexible outer element 120 may be structured and arranged as a bellows, or corrugated element, such that it folds and unfolds as the movable platform 108 moves relative to the base 106.

Of course, it is understood and appreciated that the actuator 118 may take other forms such as, but not limited to, a pneumatic jack. Such a pneumatic jack may have one or more internal or external telescoping stabilizers to permit significant vertical movement between the base and the movable platform with limited horizontal movement as between the base 106 and the movable platform 108.

For at least one embodiment the actuator 118 may include a secondary drive mechanism (not shown) such as a sliding tray or rail assembly such that independent of vertical movement between the base 106 and the movable platform 108, the relative horizontal movement between the base 106 and the movable platform 108 may also be achieved. Such a secondary drive mechanism and sliding tray or rail assembly may also be structured and arranged to permit the movable platform 108 to tilt forward, backward, and side to side.

Figure 3:
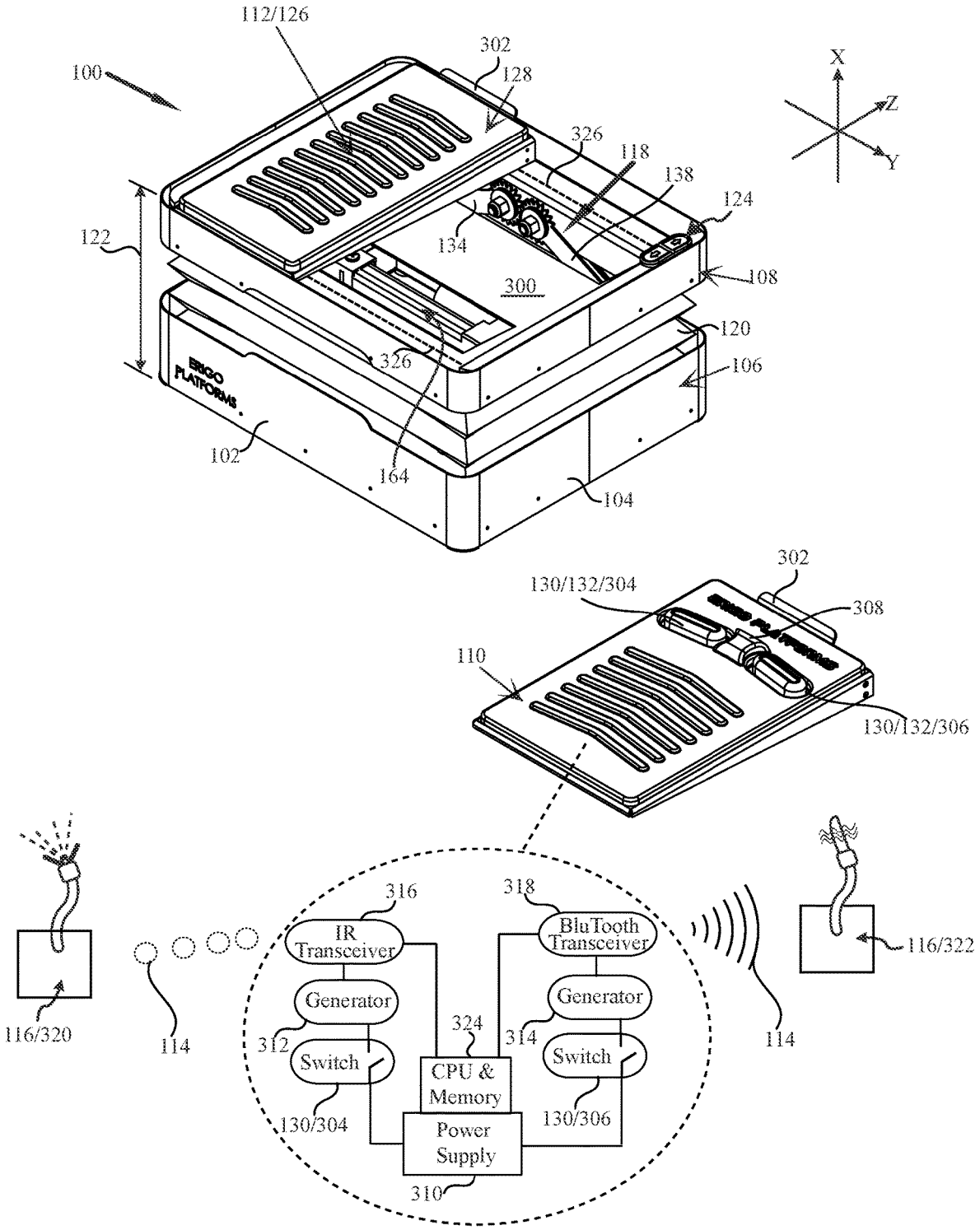
FIG. 3 is a top perspective view of the adjustable standing platform shown in FIG. 1A, with the foot pedal controller removed in, accordance with at least one embodiment.

In FIG. 3, the foot pedal controller 110 has been removed from the standing area 112. As shown, for at least one embodiment the movable platform 108 has structural supports 300 about the inner perimeter and across the center so as to receive and distribute the weight of the user throughout the frame of ASP 100. With the foot pedal controller 110 removed, it may be appreciated that for at least one embodiment the foot pedal controller 110 provides a tab 302 to facilitate easy lifting and placement foot pedal controller 110. Finger holes (not shown) may also be provided in various embodiments to facilitate easy grasping. The spacer 128 may also provide a tab 302.

With foot pedal controller 110 removed from the ASP 100, it may be more easily appreciated the exemplary embodiment provides two foot activated elements 130 as oval shaped press buttons/press switches 132/304 and 132/306. Between them is a reference element 308, such as a bump, hump, or other elevated element. As will be further described below, reference element 308 may be provided to assist the user in orienting his or her foot for proper identification and location of the respective buttons/press switches 132/304 and 132/306.

With respect to the removed foot pedal controller 110, FIG. 3 also provides a conceptual circuit diagram for the elements within the foot pedal controller 110, demonstrating the internal power supply 310, two foot activated elements 130, e.g. press switches 130/304 and 130/306, signal/code generators 312 and 314 and two transceiver 316 and 318. The activation of press switch 306 or 308 results in a different circuit, each providing a different signal/code being wirelessly transmitted to the remote base unit 116/320 or 116/322.

For illustrative purposes, transceiver 316 will be understood to be an infrared transceiver for activation and deactivation of remote base 116/320 controlling a pump, and transceiver 318 will be understood to be a Bluetooth transceiver for activation and deactivation of remote base 116/322 controlling an electrocauterizing tool.

For purposes of this discussion and ease of illustration, it will be understood and appreciated that the signal generators 312 and 314 are memory devices, or other electrical components which have been structured and arranged to repeatedly provide a specific code—this may be a frequency of sound, light, pulse of light or sound, RF signal etc. . . . which represents a command, such as "on"/"off". For at least one embodiment, the signal generators 312 and 314 may be programmable much as with a traditional universal TV remote so as to permit the ASP 100 to "learn" a code for a specific remote device. In varying embodiments, the "learning" may be simply achieved by pointing the original remote for the device at the transceiver 316/318, or by an application on a smart device such as a mobile smart phone that is wirelessly or physically connected to the foot pedal controller 110 for configuration.

Although the signal generators 312/314 and transceivers 316/318 have been conceptually illustrated as distinct elements, it will be understood and appreciated that they may be combined or otherwise share resources on one or more printed circuit boards. Further, for at least one embodiment a central processing unit, e.g., a CPU and memory 324, may be optionally provided such as may be desired for the generation and sending of more complex codes and/or enabling foot pedal controller 110 with greater capabilities of control.

In addition, although for at least one embodiment the foot pedal controller 110 has its own internal power supply 304, for at least one embodiment, ASP provides electrical contacts 326 along portions of the structural supports, such that when foot pedal controller 110 is disposed upon the movable platform 108, the foot pedal controller 110 can receive power from the ASP 100 itself.

Figure 4:
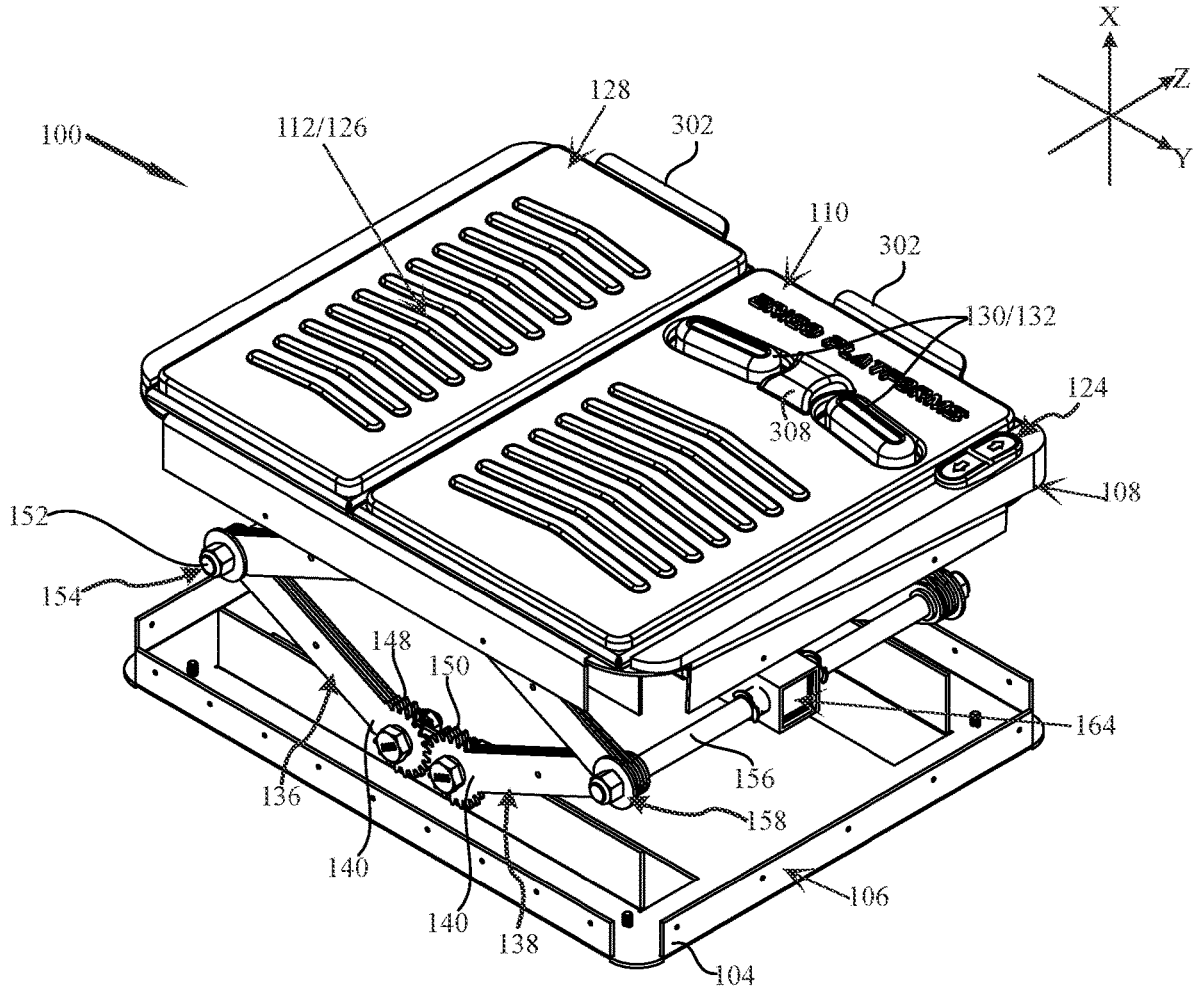
FIG. 4 is a top perspective view of the adjustable standing platform shown in FIG. 1A with the flexible outer element and lower side wall removed, in accordance with at least one embodiment.

FIG. 4 provides a perspective view of an embodiment of ASP 100 as shown in FIGS. 1A, 1B, 1C and 2A, 2B, 2C with the flexible outer element 166 and lower exterior sidewall of the base removed, so as to further appreciate the mechanical configuration of the scissor jack 134, and more specifically the first supports 136 and second supports 138, gears 148 and 150, and second cross pin 156.

Figure 5:
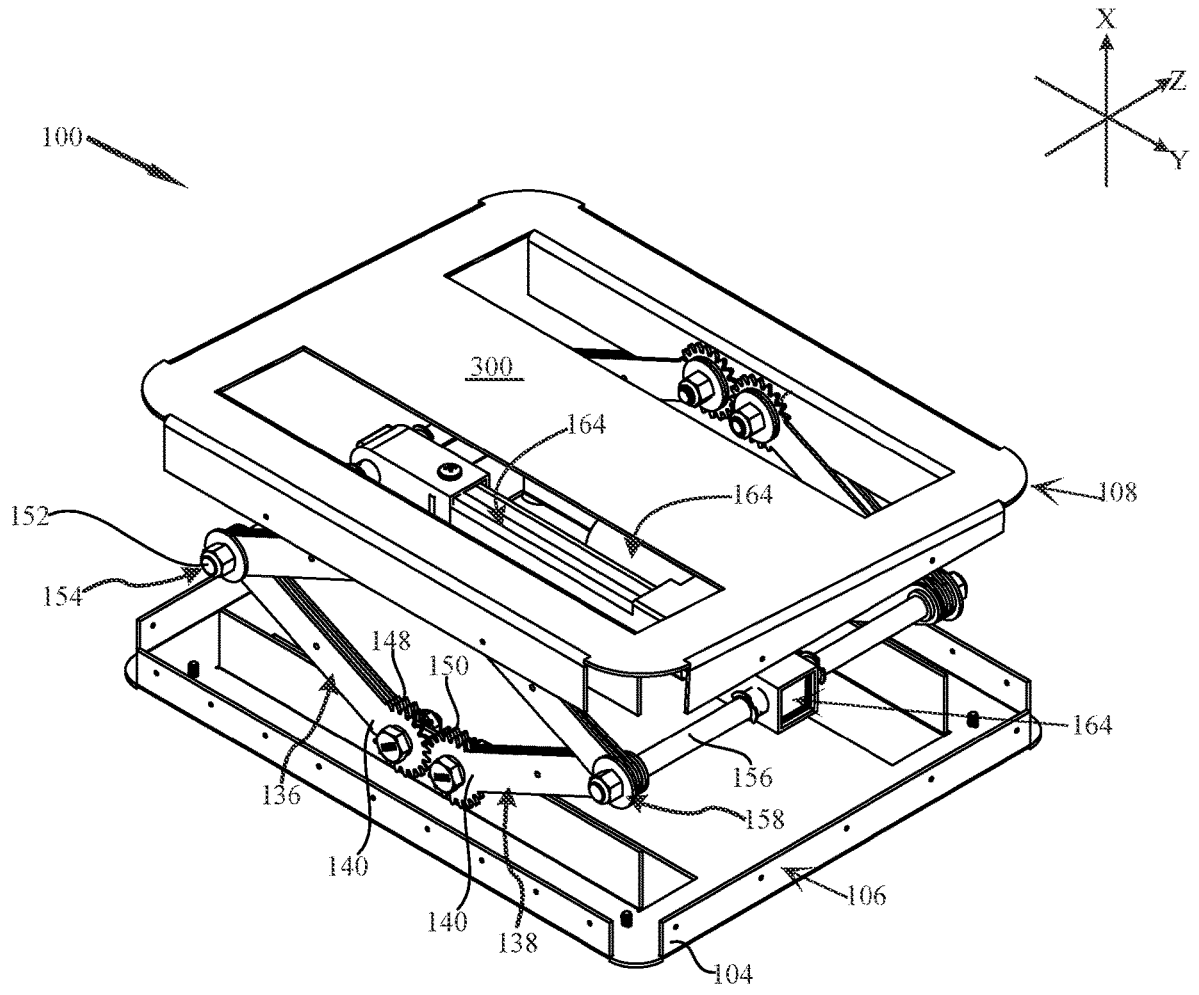
FIG. 5 is a similar top perspective view of the adjustable standing platform shown in FIG. 4 with the spacer and foot pedal controller removed to show the structural support frame, in accordance with at least one embodiment.

FIG. 5 is a substantially similar view as in FIG. 4, with the spacer 128 and foot pedal controller 110 now also removed so as to appreciate more fully the structural frame 500 of ASP 100 in accordance with at least one embodiment.

Figure 6:
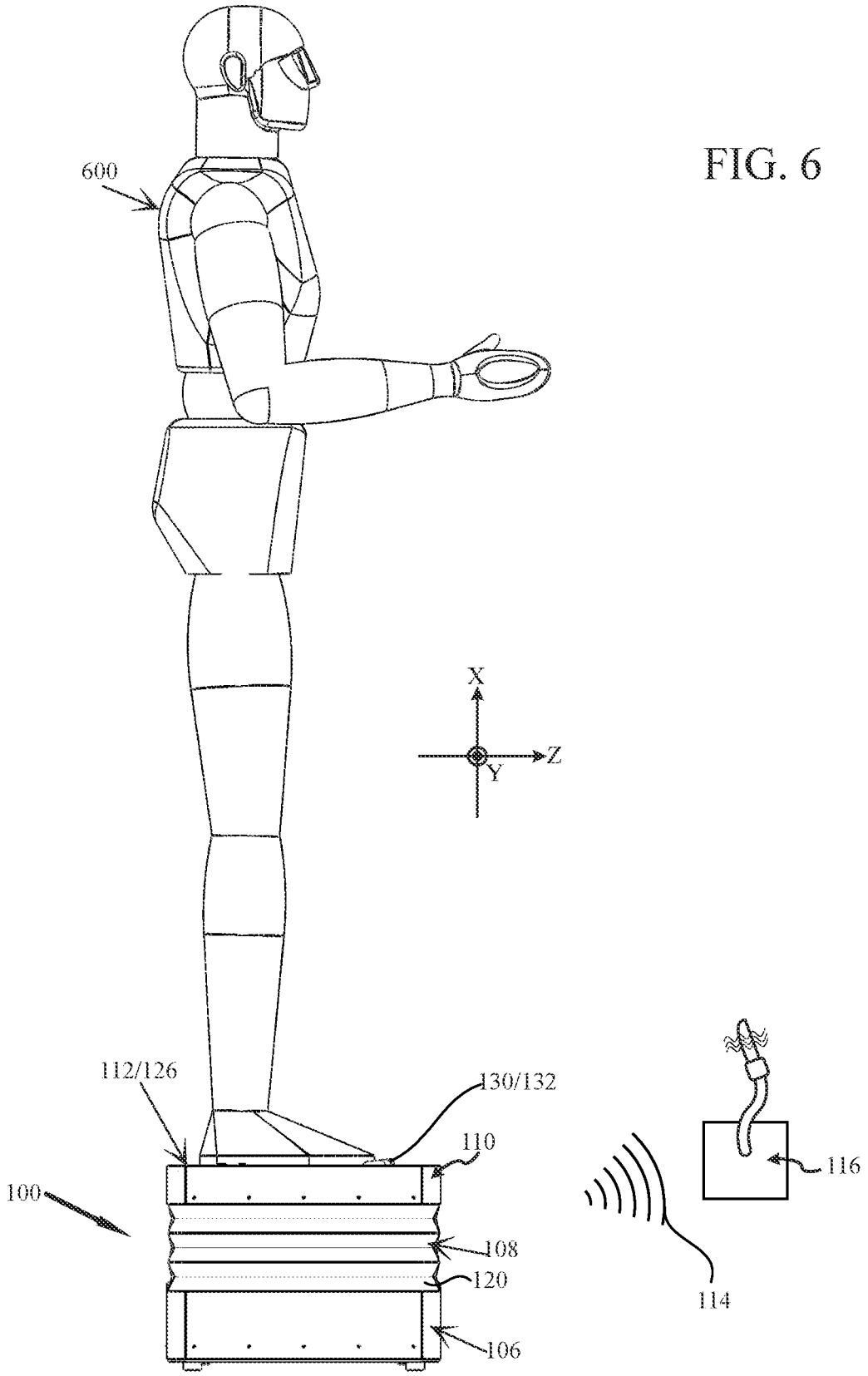
FIG. 6 is a side view of a person standing on the adjustable standing platform in accordance with at least one embodiment.
Figure 7:
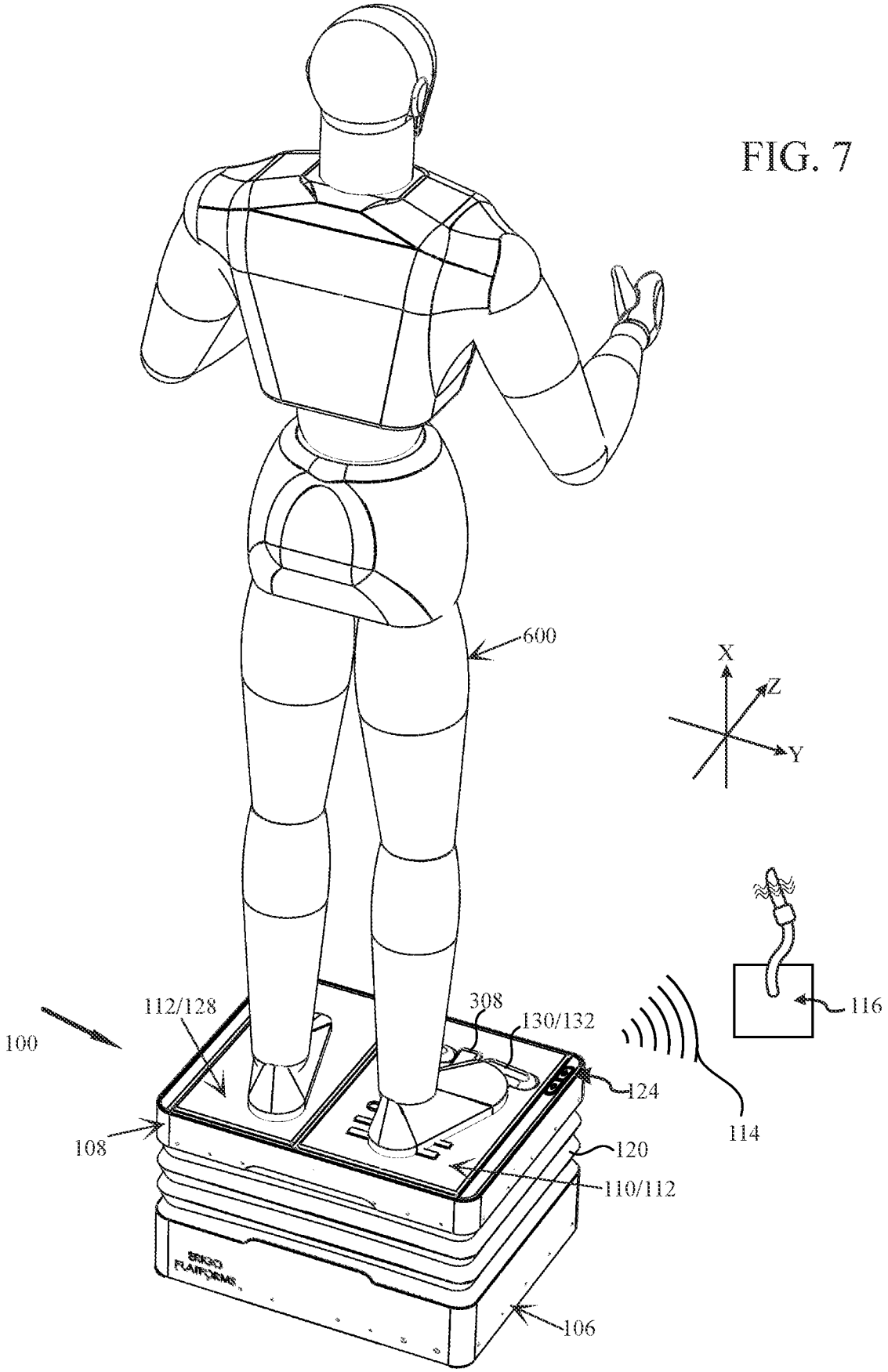
FIG. 7 is a top perspective view of a person standing on the adjustable standing platform in accordance with at least one embodiment.
Figure 8:
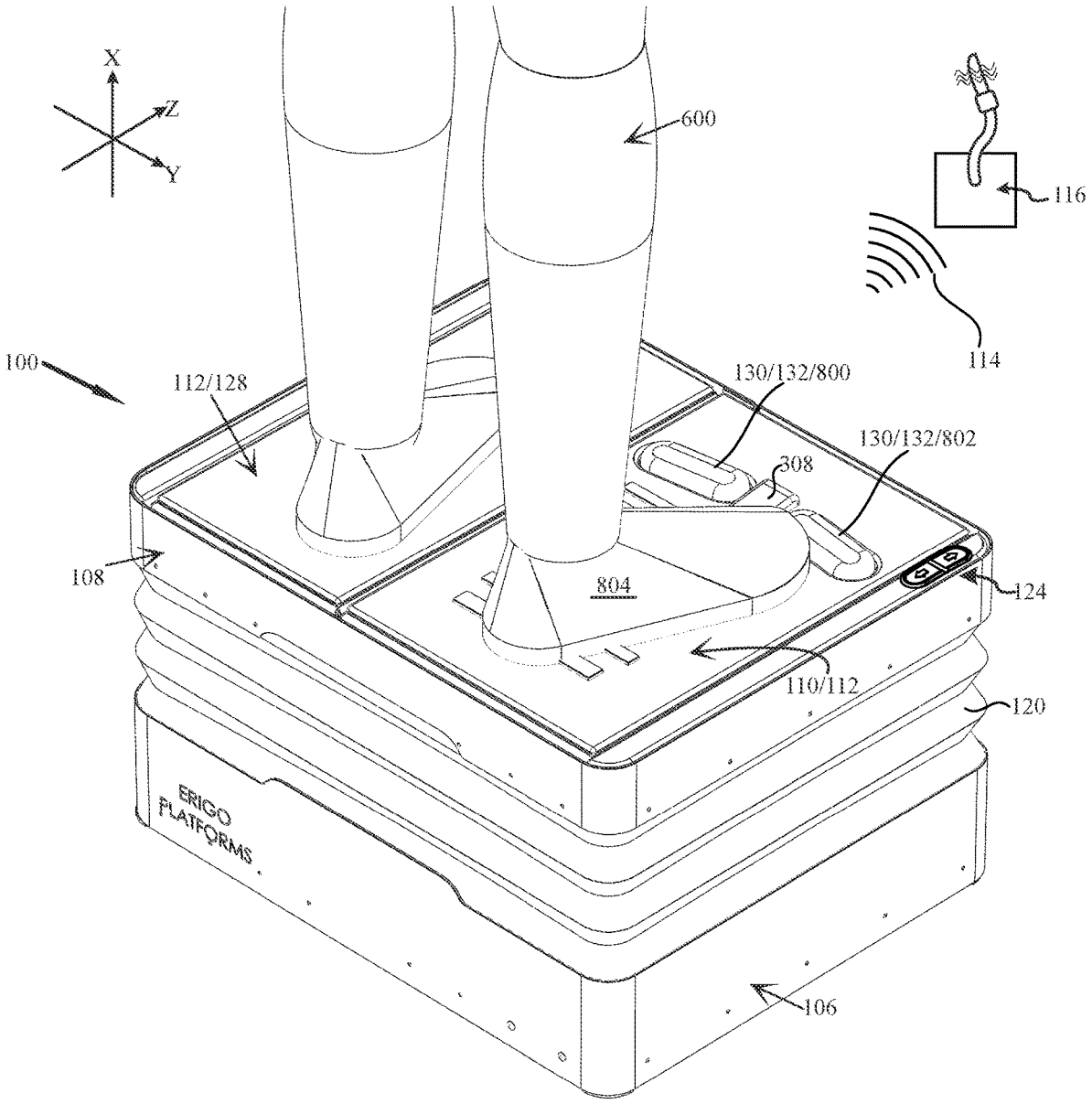
FIG. 8 is an enlarged perspective view of the person's feet standing on the adjustable standing platform in accordance with at least one embodiment.

FIGS. 6, 7 and 8 respectively show a user 600 standing on the ASP 100. More specifically, FIG. 6 is a side view, FIG. 7 is a top perspective view and FIG. 8 in an enlarged perspective foot view With respect to FIG. 7, and even more specifically FIG. 8, the location of the user's right foot upon the removable foot pedal controller 110 as shown in FIGS. 1 and 2 may be more fully appreciated. As shown in the previous figures, here again are two foot activated elements 130 shown as oval buttons 800 and 802. With the presence of the user's foot 804 also shown, it may be appreciated that a reference element 308, such as a bump, is disposed between buttons 802 and 804. It will be understood and appreciated that this reference element 308 is provided to assist the user in establishing where on the standing area 112 his or foot is with respect to buttons 800 and 802. More simply stated, the user can bump, press or otherwise explore the reference element 308 to confirm where his or her foot is before depressing either button 802 or button 804.

Further, with respect to FIGS. 3-5, it will be understood and appreciated that for at least one embodiment, the standing area 112 is of sufficient size to permit the user to move his or her feet and even angle them, as well as change their relative positions without significant risk of falling off the side.

In reflection of the above description, it will be appreciated that for at least one embodiment, the ASP may be summarized as a base 106 structured and arranged to be disposed upon a support surface; a movable platform 108 disposed above and generally parallel to the base 106, the movable platform 108 having at least one removable foot pedal controller 110 providing at least a portion of a standing area 112, each removable foot pedal controller 110 in wireless communication 114 with at least one associated remote base unit 116; an actuator 118 coupling the movable platform 108 to the base 106, the actuator 118 structured and arranged to move the movable platform 108 generally towards or away from the base 106; and a flexible outer element 120 substantially enclosing the adjustable standing platform 100, the flexible outer element 120 structured and arranged to expand and contract as the movable platform 108 moves relative to the base 106.

For yet another embodiment, ASP may be alternatively summarized as a base 106 structured and arranged to be disposed upon a support surface; a movable platform 108 disposed above and generally parallel to the base 106, the movable platform 108 having a plurality of foot activated elements 130, at least a subset of the plurality of foot activated elements 130 in wireless communication 114 with at least one remote base unit 116; an actuator 118 coupling the movable platform 108 to the base 106, the actuator 118 structured and arranged to move the movable platform 108 generally towards or away from the base 106 in response to activation of at least one of the plurality of foot activated elements 130; and a flexible outer element 120 substantially enclosing the adjustable standing platform 100, the flexible outer element 120 structured and arranged to expand and contract as the movable platform 108 moves relative to the base 106.

Having described various physical embodiments of the ASP 100, it will also be understood and appreciated that the present invention provides at least one method of providing an ASP 100. Moreover, for at least one embodiment, an advantageous ASP 100 as shown and described above may be provided by providing a base 106 structured and arranged to be disposed upon a support surface; providing a movable platform 108 disposed above and generally parallel to the base 106, the movable platform 108 having at least one removable foot pedal controller 110 providing at least a portion of a standing area 112, each removable foot pedal controller 110 in wireless communication 114 with at least one associated remote base unit 116; providing an actuator 118 coupling the movable platform 108 to the base 106, the actuator 118 structured and arranged to move the movable platform 108 generally towards or away from the base 106; and providing a flexible outer element 120 substantially enclosing the adjustable standing platform 100, the flexible outer element 120 structured and arranged to expand and contract as the movable platform 108 moves relative to the base 106.

Indeed, yet a further embodiment of the present invention is appreciated to be the advantageous use of an ASP 100 as shown and described above. Moreover, for at least one embodiment, a method of use may be summarized as providing an adjustable standing platform 100 platform for a person, the standing platform including; a base 106 structured and arranged to be disposed upon a support surface; a movable platform 108 disposed above and generally parallel to the base 106, the movable platform 108 having a standing area 112, disposed within the standing area 112 is at least one removable foot pedal controller 110*s*, each removable foot pedal controller 110 in wireless communication 114 with at least one associated remote base unit 116; an actuator 118 coupling the movable platform 108 to the base 106, the actuator 118 structured and arranged to move the movable platform 108 generally towards or away from the base 106; and a flexible outer element 120 substantially enclosing the adjustable standing platform 100, the flexible outer element 120 structured and arranged to expand and contract as the movable platform 108 moves relative to the base 106; stepping onto the adjustable standing platform 100 platform; using a foot to activate and manipulate at least one foot activated position controller disposed proximate to the standing area 112 to adjust the height of the platform to a preferred level; and using the at least one removable foot pedal controller 110 for the wireless control of at least one device.

Figure 9:
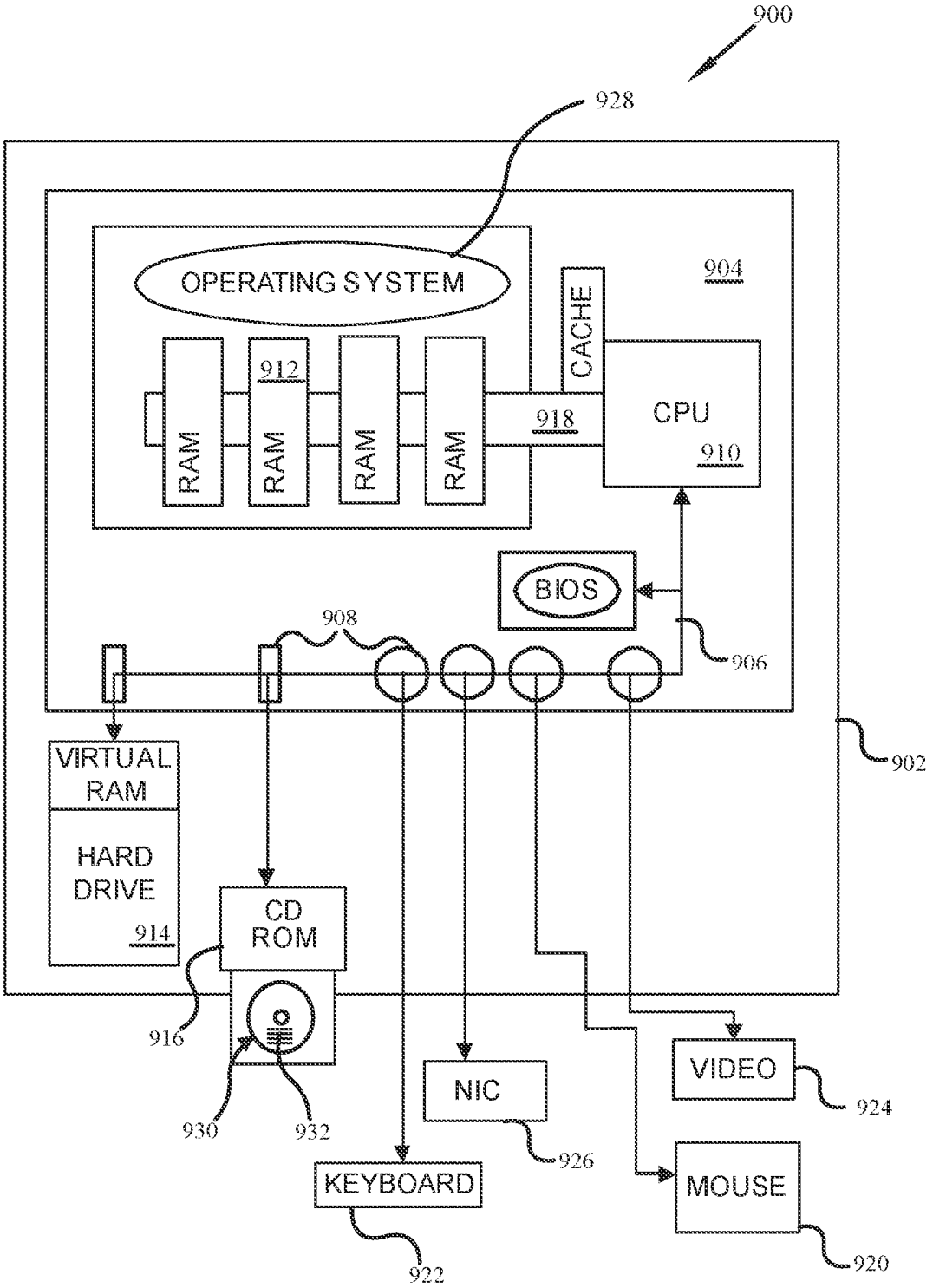
FIG. 9 is a high-level block diagram of a computer system in accordance with at least one embodiment.

To expand upon the initial suggestion of at the foot pedal controller 110 having a central processing unit and memory (CPU and memory 324) if not also the ASP itself for additional advantages such as pre-set height adjustments for known users, and/or additional control of remote devices, it will be understood and appreciated that various embedments of the ASP 100 and elements thereof—e.g. the foot pedal controller(s) 110 and/or foot activated element(s) 130, and remote base unit(s) 116 may be computer systems adapted to their specific rolls, FIG. 9 is a high level block diagram of an exemplary computer system 900 such as may be provided for one or more of the elements comprising the ASP 100, foot activated element(s) 130 foot pedal controller(s) 110, and remote base unit(s) 116, and/or other computing devices whether provided as distinct individual systems or integrated together in one or more computer systems.

Computer system 900 has a case 902, enclosing a main board 904. The main board 904 has a system bus 906, connection ports 908, a processing unit, such as Central Processing Unit (CPU) 910 with at least one microprocessor (not shown) and a memory storage device, such as main memory 912, hard drive 914 and CD/DVD ROM drive 916.

Memory bus 918 couples main memory 912 to the CPU 910. A system bus 906 couples the hard disc drive 914, CD/DVD ROM drive 916 and connection ports 908 to the CPU 910. Multiple input devices may be provided, such as, for example, a mouse 920 and keyboard 922. Multiple output devices may also be provided, such as, for example, a video monitor 924 and a printer (not shown). As computer system 900 is intended to be interconnected with other computer systems, a combined input/output device such as at least one network interface card, or NIC 926 is also provided.

Computer system 900 may be a commercially available system, such as a desktop workstation unit provided by IBM, Dell Computers, Gateway, Apple, or other computer system provider. Computer system 900 may also be a networked computer system, wherein memory storage components such as hard drive 914, additional CPUs 910 and output devices such as printers are provided by physically separate computer systems commonly connected in the network.

Those skilled in the art will understand and appreciate that the physical composition of components and component interconnections are comprised by the computer system 900, and select a computer system 900 suitable for one or more of the computer systems incorporated in the formation and operation of an ASP 100, foot activated element(s) 130 foot pedal controller(s) 110, remote base unit(s) 116, or other device associated with the advantageous use and operation of ASP 100.

When computer system 900 is activated, preferably an operating system 928 will load into main memory 912 as part of the boot strap startup sequence and ready the computer system 900 for operation. At the simplest level, and in the most general sense, the tasks of an operating system fall into specific categories, such as process management, device management (including application and User interface management) and memory management, for example. The form of the computer-readable medium 930 and language of the program 932 are understood to be appropriate for and functionally cooperate with the computer system 900.

Changes may be made in the above methods, systems and structures without departing from the scope hereof. It should thus be noted that the matter contained in the above description and/or shown in the accompanying drawings should be interpreted as illustrative and not in a limiting sense. Indeed, many other embodiments are feasible and possible, as will be evident to one of ordinary skill in the art. The claims that follow are not limited by or to the embodiments discussed herein, but are limited solely by their terms and the Doctrine of Equivalents.

What is claimed:

1. An adjustable standing platform for a person, comprising:

a base structured and arranged to be disposed upon a support surface;

a movable platform disposed above and generally parallel to the base, the movable platform having at least one removable foot pedal controller providing at least a portion of a standing area, each of the at least one removable foot pedal controller in wireless communication with at least one associated remote base unit;

an actuator coupling the movable platform to the base, the actuator structured and arranged to move the movable platform generally towards or away from the base; and a flexible outer element enclosing the adjustable standing platform, the flexible outer element structured and arranged to expand and contract as the movable platform moves relative to the base.

2. The adjustable standing platform of claim 1, wherein there are at least two removable foot pedal controllers.

3. The adjustable standing platform of claim 1, further including at least one removable spacer disposed adjacent to the at least one foot pedal controller, the at least one removable spacer providing at least a portion of the standing area.

4. The adjustable standing platform of claim 3, wherein the at least one removable spacer and the at least one removable foot pedal controller are arranged to present the removable foot pedal controller substantially centered in the standing area.

5. The adjustable standing platform of claim 3, wherein the at least one removable spacer and the at least one removable foot pedal controller are arranged to present the removable foot pedal controller substantially in a left portion of the standing area.

6. The adjustable standing platform of claim 3, wherein the at least one removable spacer and the at least one removable foot pedal controller are arranged to present the removable foot pedal controller substantially in a right portion of the standing area.

7. The adjustable standing platform of claim 1, wherein the actuator moves the movable platform vertically in a generally parallel relation to the support surface.

8. The adjustable standing platform of claim 1, wherein the actuator moves the movable platform to tilt the movable platform relative to the support surface.

9. The adjustable standing platform of claim 1, wherein the actuator further comprising at least one scissor jack activated by a motor, the motor coupled to a power supply by a position controller, the position controller responsive to a user request to move the movable platform in at least one direction.

10. The adjustable standing platform of claim 9, wherein the user request is provided by activation of at least one foot activated position controller.

11. The adjustable standing platform of claim 9, wherein the user request is provided by voice command.

12. The adjustable standing platform of claim 1, wherein at least one of the at least one removable foot pedal controller has a wireless transceiver for direct communication with the at least one associated remote base unit.

13. The adjustable standing platform of claim 1, wherein the at least one removable foot pedal controller provides at least one foot activated button as a tactile area.

14. The adjustable standing platform of claim 1, wherein the actuator is controlled by at least one foot activated position controller disposed proximate to the standing area.

15. An adjustable standing platform for a person, comprising:

a base structured and arranged to be disposed upon a support surface;

a movable platform disposed above and generally parallel to the base, the movable platform having a standing area, the standing area provided at least in part by at least one removable foot pedal controller, each of the at least one removable foot pedal controller in wireless communication with at least one associated remote base unit;

an actuator coupling the movable platform to the base, the actuator structured and arranged to move the movable platform generally towards or away from the base; and a flexible outer element substantially enclosing the adjustable standing platform, the flexible outer element structured and arranged to expand and contract as the movable platform moves relative to the base.

16. The adjustable standing platform of claim 15, wherein there are at least two removable foot pedal controllers.

17. The adjustable standing platform of claim 15, further including at least one removable spacer disposed adjacent to the at least one foot pedal controller, the at least one removable spacer providing at least a portion of the standing area.

18. The adjustable standing platform of claim 17, wherein the at least one removable spacer and the at least one removable foot pedal controller may be are arranged to present the removable foot pedal controller substantially centered in the standing area.

19. The adjustable standing platform of claim 17, wherein the at least one removable spacer and the at least one removable foot pedal controller may be are arranged to present the removable foot pedal controller substantially in a left portion of the standing area.

20. The adjustable standing platform of claim 17, wherein the at least one removable spacer and the at least one removable foot pedal controller may be are arranged to present the removable foot pedal controller substantially in a right portion of the standing area.

21. The adjustable standing platform of claim 15, wherein the actuator moves the movable platform vertically in a generally parallel relation to the support surface.

22. The adjustable standing platform of claim 15, wherein the actuator moves the movable platform to tilt the movable platform relative to the support surface.

23. The adjustable standing platform of claim 15, wherein the actuator further comprising at least one scissor jack activated by a motor, the motor coupled to a power supply by a controller, the controller responsive to a user request to move the movable platform in at least one direction.

24. The adjustable standing platform of claim 23, wherein the user request is provided by activation of at least one foot activated position controller.

25. The adjustable standing platform of claim 23, wherein the user request is provided by voice command.

26. The adjustable standing platform of claim 15, wherein at least one of the at least one removable foot pedal controller has a wireless transceiver for direct communication with the remote unit.

27. The adjustable standing platform of claim 15, wherein the at least one removable foot pedal controller provides at least one foot activated button as a tactile area.

28. The adjustable standing platform of claim 15, the actuator is controlled by at least one foot activated position controller disposed proximate to the standing area.

29. An adjustable stand for a person, comprising:

a base structured and arranged to be disposed upon a support surface;

a movable platform disposed above and generally parallel to the base, the movable platform having a plurality of foot activated elements, at least a subset of the foot activated elements providing a standing area, at least a portion of the subset of the plurality of foot activated elements in wireless communication with at least one remote base unit;

an actuator coupling the movable platform to the base, the actuator structured and arranged to move the movable platform generally towards or away from the base in response to activation of at least one of the plurality of foot activated elements; and a flexible outer element substantially enclosing the adjustable standing platform, the flexible outer element structured and arranged to expand and contract as the movable platform moves relative to the base.

30. The adjustable stand of claim 29, wherein at least a subset of the plurality of foot activated elements are disposed in at least one removable foot pedal controller, the at least one foot pedal controller providing at least a portion of a standing area for the person.

31. The adjustable stand of claim 30, further including at least one removable spacer disposed adjacent to at least one of the foot pedal controllers, the at least one removable spacer providing at least a portion of the standing area.

32. The adjustable stand of claim 30, wherein the at least one removable spacer and the at least one removable foot pedal controller are arranged to present the removable foot pedal controller in a first instance substantially on the right of the standing area, in a second instance substantially on the left of the standing area, and in a third instance as substantially centered in the standing area.

33. The adjustable stand of claim 29, wherein the actuator moves the movable platform vertically in a generally parallel relation to the support surface.

34. The adjustable stand of claim 29, wherein the actuator moves the movable platform to tilt the movable platform relative to the support surface.

35. The adjustable stand of claim 29, wherein the actuator further comprising at least one scissor jack activated by a motor, the motor coupled to a power supply by a controller, the controller responsive to a user request to move the movable platform in at least one direction.

36. The adjustable stand of claim 35, wherein the user request is provided by activation of at least one foot activated position controller.

37. The adjustable stand of claim 35, wherein the user request is provided by voice command.

38. The adjustable stand of claim 29, wherein at least one removable foot pedal controller provides at least one foot activated button as a tactile area.

39. The adjustable stand of claim 29, actuator is controlled by at least one foot activated position controller disposed proximate to the standing area.

* * * * *